United States Patent [19]

Gordbegli et al.

[11] Patent Number: 4,460,944

[45] Date of Patent: Jul. 17, 1984

[54] HEAT SENSITIVE POOL LIGHT

[75] Inventors: Manochehr Gordbegli, Santa Ana; Joe Mendoza, Garden Grove, both of Calif.

[73] Assignee: Purex Pool Products, Inc., Lakewood, Calif.

[21] Appl. No.: 495,524

[22] Filed: May 17, 1983

[51] Int. Cl.[3] ..... F21V 25/04

[52] U.S. Cl. ..... 362/276; 362/101; 362/145; 362/267; 362/311; 362/364; 362/365; 362/373; 362/376; 362/802

[58] Field of Search ..... 362/802, 276, 267, 295, 362/364, 373, 158, 376, 101; 307/118

[56] References Cited

U.S. PATENT DOCUMENTS 4,107,514 8/1978 Ellson ..... 362/397 X
4,216,411 8/1980 Ehret et al. ..... 362/295 X
4,234,819 11/1980 Maxey ..... 362/802 X
4,290,094 9/1981 Jensen ..... 362/293 X

*Primary Examiner*—Donald G. Kelly
*Assistant Examiner*—John S. Maples
*Attorney, Agent, or Firm*—William W. Haefliger

[57] ABSTRACT

A light unit assembly adapted to illuminate liquid below a liquid surface (for example of a pool or spa) includes (a) a lamp unit including a metallic housing adapted to be cooled by heat transfer to the liquid, and lamp circuitry, (b) a thermostat coupled to the lamp circuitry to control electrical energization of the lamp, and (c) a heat conductive metallic strip associated with said housing and thermostat to become increasingly heated for changing the conductive state of the lamp in response to diminished cooling of the housing by said liquid.

6 Claims, 7 Drawing Figures

HEAT SENSITIVE POOL LIGHT

BACKGROUND OF THE INVENTION

This invention relates generally to lights located below liquid surface level, as in swimming pools and spas, and more particularly concerns improvements in pool or spa light safety features.

Existing swimming pool and spa lights can become troublesome or dangerous if the water level falls too far to expose the lights to air. If they are left "ON" under such conditions, there is risk of shock hazard, damage to wiring insulation due to generation of excessive heat not conducted to the adjacent water body, and the possibility of lens explosion due to excessive heat build-up. U.S. Pat. No. 3,914,592 discloses one approach to these problems, but lacks the simplicity and greater reliability of the apparatus of the present invention.

SUMMARY OF THE INVENTION

It is a major object of the invention to provide apparatus obviating the above problems, as well as providing additional unusual structural and functional advantages, as will appear. Basically, the light assembly of the invention is adapted to illuminate a liquid, below liquid surface level, and comprises:

(a) a lamp unit including a metallic housing adapted to be cooled by heat transfer to the liquid, (b) a thermostat coupled to the lamp to control electrical energization thereof, and (c) a heat conductive metallic strip associated with the housing and thermostat to become increasingly heated for changing the conductive state of the lamp in response to diminished cooling of the housing by said liquid.

Further, the metallic strip may be protectively located at the inner side of the housing and in heat transfer relation with that inner side, and the thermostat may have a receptacle contacting that strip, holding it in metal-to-metal contact with the housing. Also, the strip is advantageously located adjacent the upper side of the frusto-conical housing to begin sensing heat build-up as the water surface level begins to drop below the level of the upper side of the housing.

These and other objects and advantages of the invention, as well as the details of an illustrative embodiment, will be more fully understood from the following description and drawings, in which:

DRAWING DESCRIPTION

DETAILED DESCRIPTION

Figure 1:
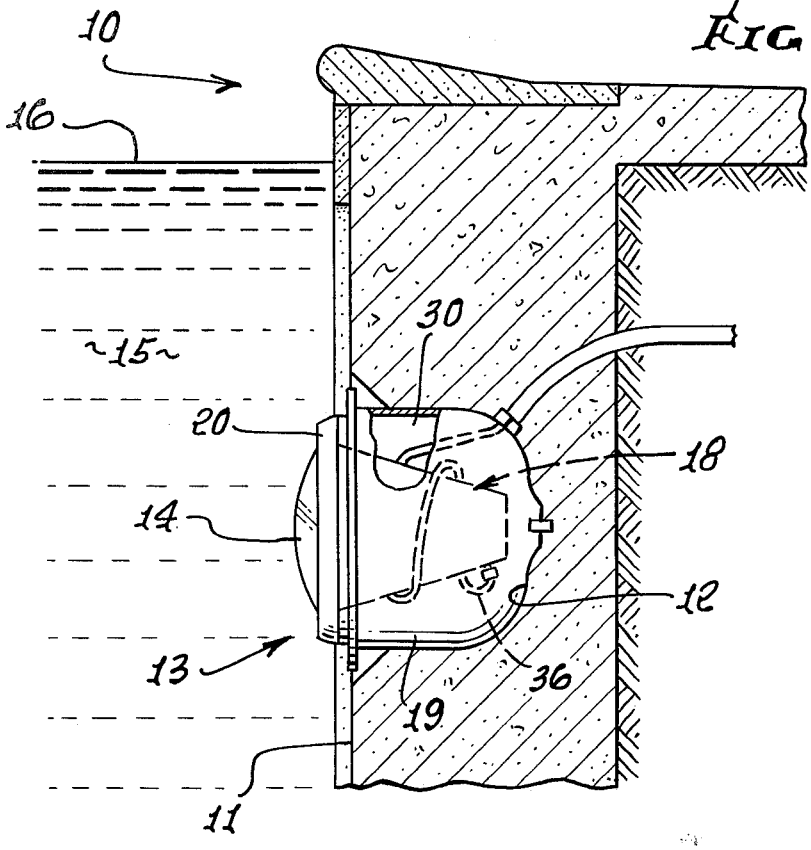
FIG. 1 is an elevation, in partial section, showing an underwater light assembly incorporating the invention.
Figure 5:
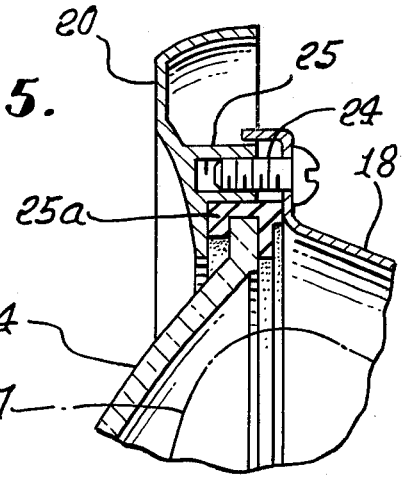
FIG. 5 is a fragmentary elevation showing details of the FIG. 1 light assembly.

In FIG. 1, a pool or spa 10 has a side wall 11 in which a niche 12 is formed. A light assembly 13 is received in the niche and has a lens 14 facing the interior of the pool or spa containing water body 15. The normal water level is indicated at 16, so that the light assembly is underwater and heat generated by electrical lamp 17 (see FIGS. 2 and 5) is dissipated via the metallic housing 18, metal shell 19 and metal face ring 20 to the water body. Should the water level 16 drop below the level of the lens, the lamp 17 if it remains energized, may excessively heat the assembly 13 to damage same, as for example the ends of wires 21-23 in the assembly, or other parts and electrical connections. Also, if touched, the heated face ring may burn the skin.

Note in regard to the above the attachment, by fasteners 24, of metal flange 18*a* of housing 18 to face ring sockets 25, and the peripheral mounting of lens to the face ring via elastomeric seal ring 25*a*. The water body 15 is also representative of liquid bodies other than in a pool or spa.

In accordance with the invention, a thermostat 26, or equivalent sensor, is electrically coupled to the lamp 17 to control electrical energization thereof; and a heat conductive metallic strip 27 is associated with the housing 18 and thermostat 26 to become increasingly heated for changing the electrically conductive state of the thermostat in response to diminished cooling of the housing by the liquid.

In the example, the metal strip (as for example copper) is located at the inner side of the housing wall, which is typically of steel shell construction, and in heat transfer relation with that inner side. The outer side of the housing is typically exposed to water in space 30 (see FIG. 1).

Figure 6:
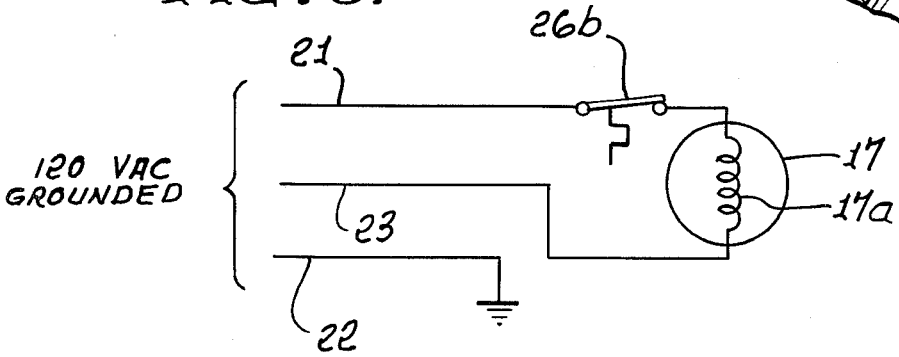
FIG. 6 is a circuit diagram.
Figure 4:
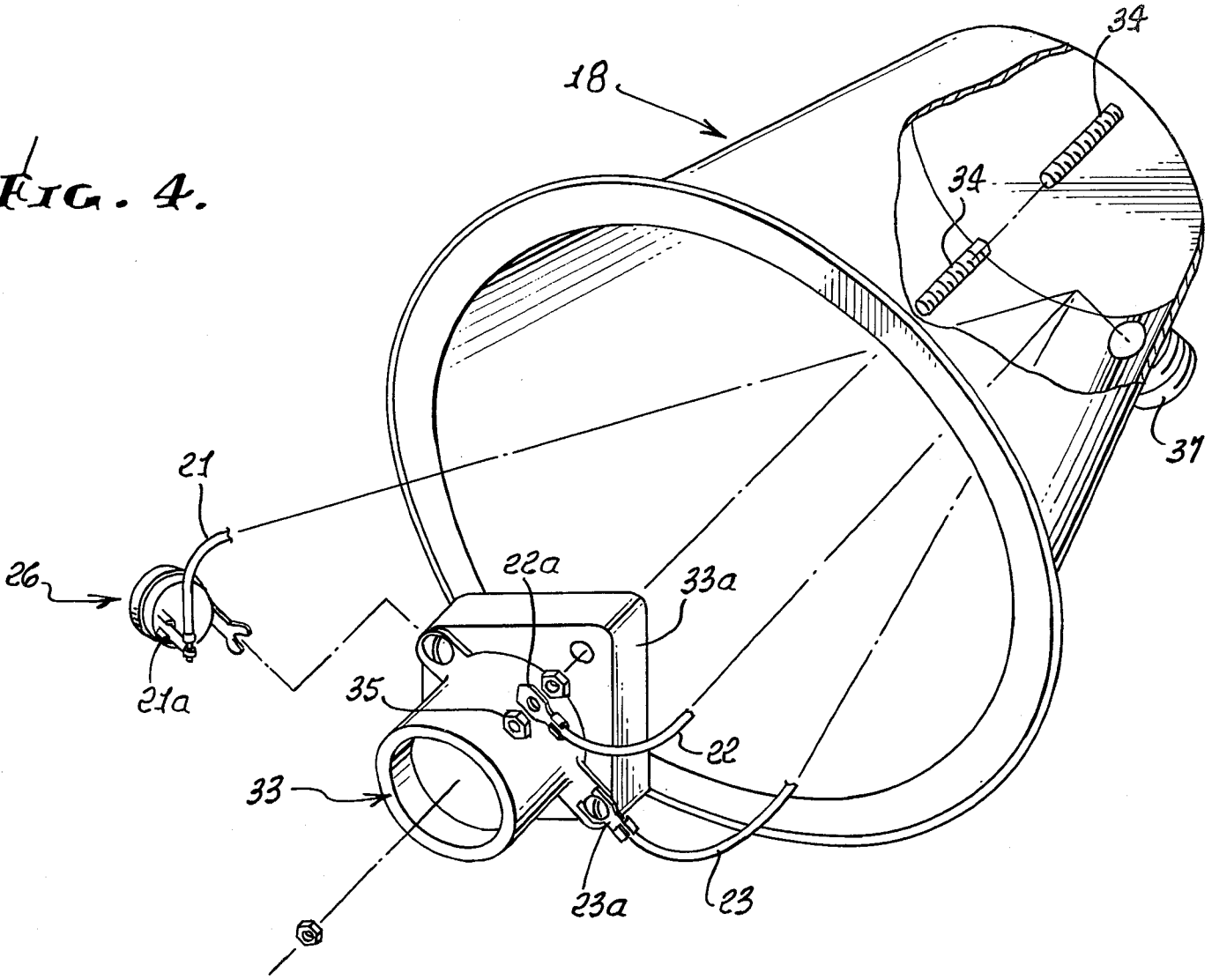
FIG. 4 is an exploded perspective view of the FIGS. 2 and 3 lamp unit.

The thermostat includes a disc shaped receptacle with a temperature sensitive flat side 26*a* engaged against strip 27 to hold the latter in position, contacting the inner side 18*b* of the housing 18. The thermostat receptacle may be held wedged in that position as by the potting compound 32 filling the interior of the housing about the ceramic lamp socket 33; or, the thermostat receptacle may be wedged between socket 33 and the strip. Note in FIGS. 2 and 4 that the lamp socket base 33*a* is also held in position by screw fasteners 34 that project through the base. A grounded wire 22 has a terminal 22*a* attached to one screw fastener 34 as by nut 35. The thermostat switching element 26*b* is connected in series with the lamp filament 17*a* and with the two wires 21 and 23, as shown in FIG. 6. See also wire terminals 21*a* and 23*a* attached, as shown in FIG. 4. These wires are gathered into a cord 36 that terminates at a tubular fitting 37 attached to the lower side of the housing 18.

Figure 2:
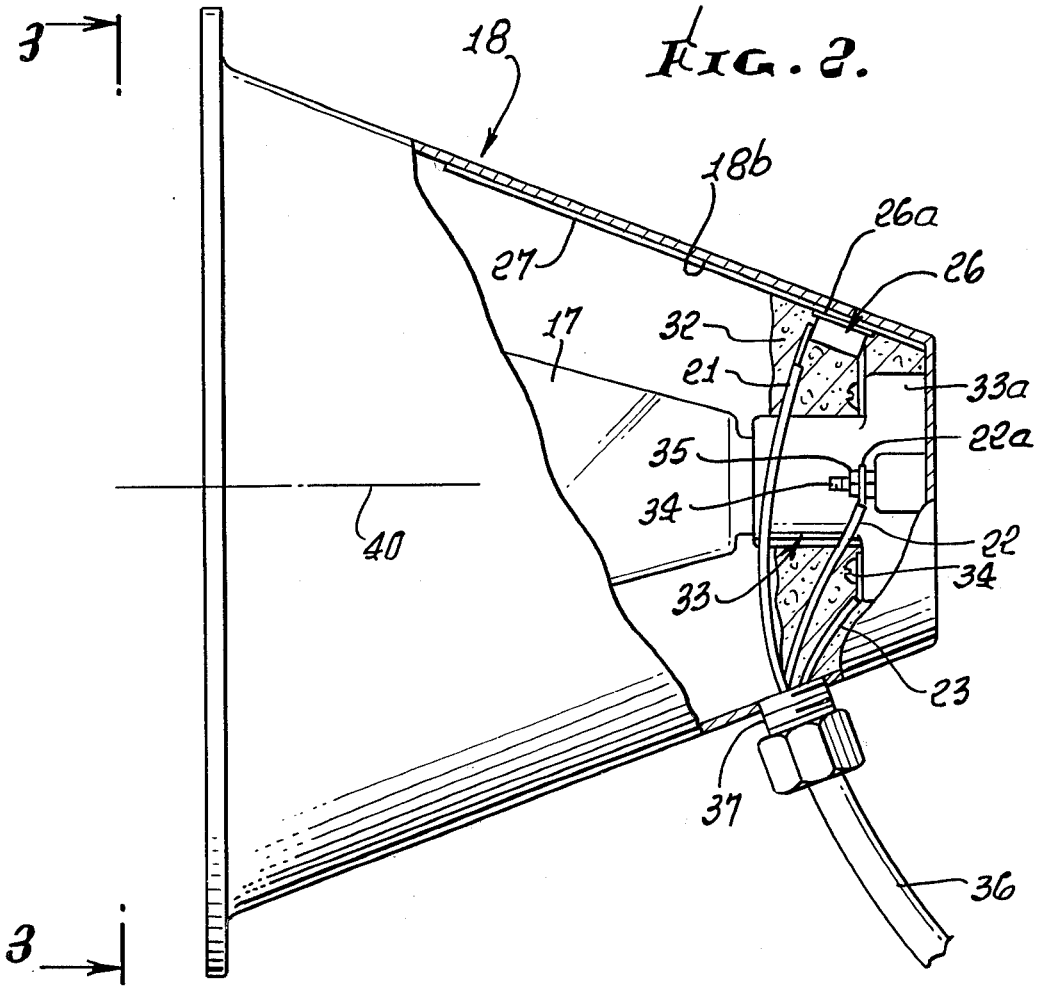
FIG. 2 is an enlarged elevation, in partial section, showing a lamp unit incorporating the invention.

Heat sensitive strip 27 is positioned adjacent the vertically upper side of the housing, and extends along a slant height dimension of the latter, as is clear from FIG. 2. Accordingly, any excessive heating of the housing 17, due to water level drop, is in turn reflected by increased heat transfer from the housing to the strip 27 and heat conduction to the thermostat, to cause opening of the thermostat switch and turn-off of the lamp. After sufficient cooling, as by return of water level to above the level of the lamp, or other selected level relative to the lamp, the switch closes, and the lamp comes back ON. Of course, a master switch controls current energization of all the lamps, as via the wires 21 and 23.

Figure 3:
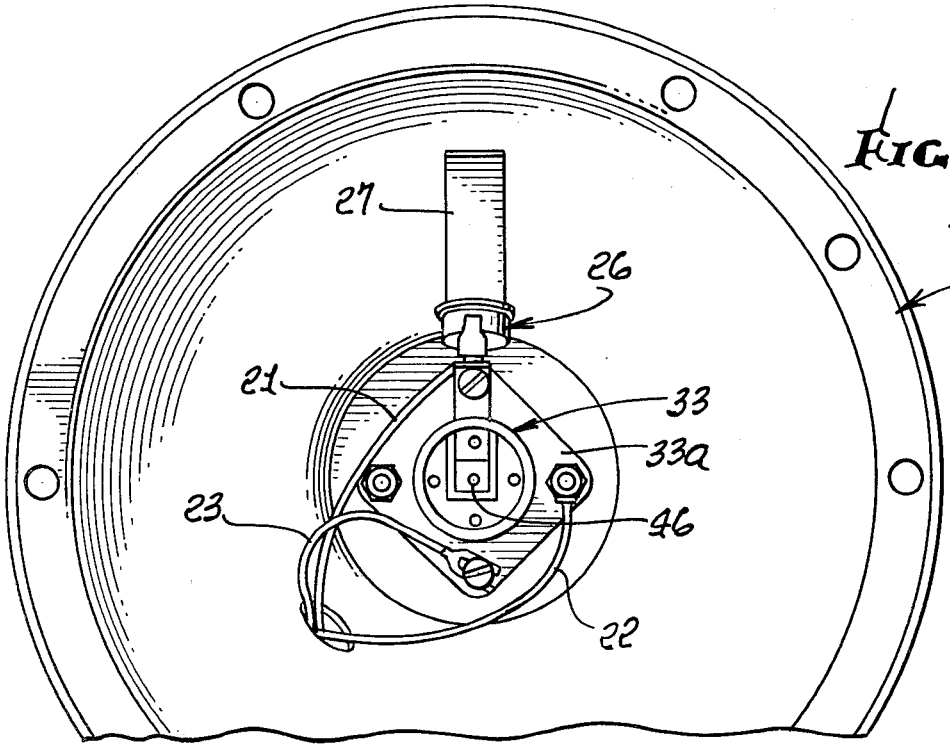
FIG. 3 is an end elevation taken on lines 3—3 of FIG. 2.

FIG. 2 also shows strip 27 located above the level of horizontal axis 40 of frusto-conical housing 18, to begin sensing heat build-up as the water level drops below the level of the upper side of the housing, i.e. above axis 40. A lamp contact is shown at 46, in FIG. 3.

Figure 7:
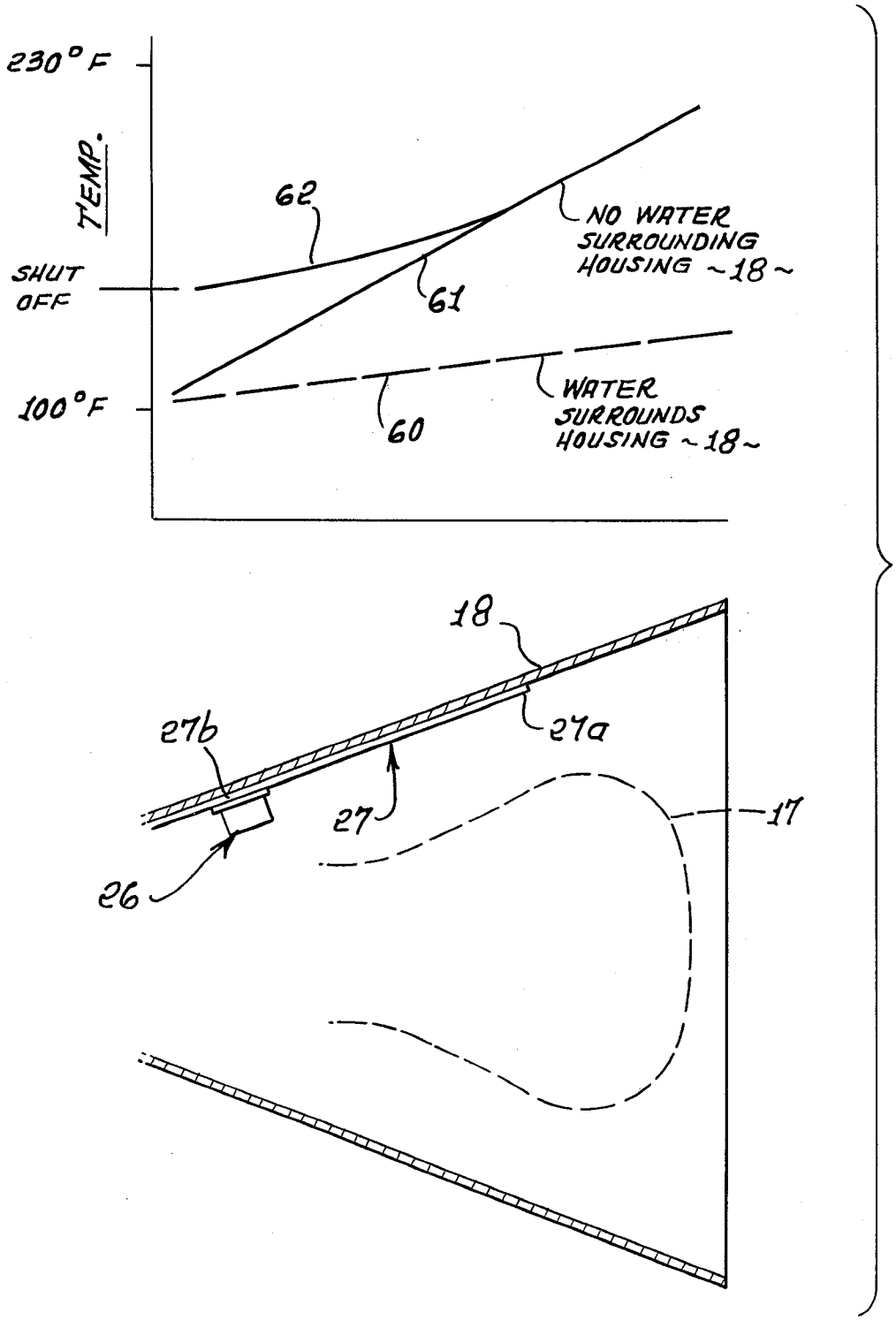
FIG. 7 is a temperature profile diagram.

FIG. 7 shows a profile of the housing temperature, along the housing length. The housing is heated by radiation from the lamp, and when water surrounds the housing heat is transferred to the water, which re-circulates to the pool. The resulting temperature profile line 60 shows that the housing temperature does not rise much above 100° F., anywhere along the housing length.

When the pool water surface level drops below the level of the housing, the temperature of the latter tends to rise toward profile line 61. Consequently the outer end 27*a* of the heat conductive strip is heated to an elevated temperature, and the temperature profile line of the strip appears at 62. The temperature of the end 27*b* of the strip closest to the thermostat 26 is caused to rise (by heat conduction from end 27*a*) to a higher level than that of the adjacent shell, causing the thermostat to shut off at a selected safe temperature (for example before the maximum temperature of the shell reaches 230° F.). In this regard, the thermostat cannot be located farther out on the shell due to UL regulations.

We claim:

1. In a light assembly adapted to illuminate liquid below a liquid surface, the combination that comprises, (a) a lamp unit including a metallic housing adapted to be cooled by heat transfer to the liquid, a lamp socket, and lamp circuitry, (b) a thermostat coupled to the lamp circuitry to control electrical energization of the lamp, and (c) an enlongated, substantially flat and heat conductive metallic strip associated with said housing and thermostat to become increasingly heated for changing the conductive state of the lamp in response to diminished cooling of the housing by said liquid, (d) the metallic strip being located at the inner side of said housing and in heat transfer relation with said inner side along the strip length, the outer side of the housing adapted to be contacted by liquid, (e) the thermostat located proximate a portion of the strip near the lamp socket, (f) the strip consisting of an elongated and good heat conducting metal extending upwardly and along the slant height dimension of said housing which is frusto-conical, and away from the thermostat.

2. The combination of claim 1 including a metallic shell adapted for reception in a niche in a pool or spa wall, the lamp unit received in said shell, the metallic strip located at the inner side of said housing and in heat transfer relation with said inner side, the outer side of the housing adapted to be contacted by said liquid which consists of pool or spa water.

3. The combination of claim 1 wherein said thermostat contacts said strip.

4. The combination of claim 2 wherein said thermostat contacts said strip and urges the strip in metal-to-metal contact with said inner side of the housing.

5. The combination of claim 4 wherein said thermostat is wedged between said socket and said strip, the strip consisting of copper.

6. The combination of claim 4 wherein the frusto-conical housing has a horizontal axis, the strip located above said axis.

* * * * *